United States Patent [19]

Kipp

[11] 4,429,825

[45] Feb. 7, 1984

[54] LEAK RESISTANT CLOSURE

[75] Inventor: Michael A. Kipp, Phoenixville, Pa.

[73] Assignee: Container Corporation of America, Chicago, Ill.

[21] Appl. No.: 415,184

[22] Filed: Sep. 7, 1982

[51] Int. Cl.[3] ..... B65D 3/00

[52] U.S. Cl. ..... 229/1.5 B; 229/4.5

[58] Field of Search ..... 229/1.5 B, 2.5 R, 3.5 R, 229/4.5, 5.5

[56] References Cited

U.S. PATENT DOCUMENTS

| | | | |
|---|---|---|---|
| 1,294,011 | 2/1919 | Williams | 229/4.5 |
| 1,923,716 | 8/1933 | Fisher | 229/5.5 |
| 3,182,882 | 5/1965 | Aellan | 229/1.5 B |
| 3,362,575 | 1/1968 | Fotor | 229/1.5 B |
| 3,583,624 | 6/1971 | Peacock | 229/3.5 R |
| 3,924,795 | 12/1975 | Smith | 229/1.5 B |
| 4,113,101 | 9/1978 | Rapp | 229/4.5 |

*Primary Examiner*—Herbert F. Ross

*Attorney, Agent, or Firm*—Richard W. Carpenter; Davis Chin

[57] ABSTRACT

A generally, sift-proof or liquid-resistant container formed from a unitary sheet of paperboard having overlapped end portions secured in a single lap joint with the inner end portion presenting an upwardly facing surface for closing the space between the container body and lid in the area of the lap joint.

1 Claim, 7 Drawing Figures

LEAK RESISTANT CLOSURE

BACKGROUND OF THE INVENTION

1. Field of the Invention

This invention relates to closure arrangements and more particularly to a leak-proof closure arrangement for a single lap cylindrical container formed of paperboard and having a plug-type closure.

2. Description of the Prior Art

A prior art search in the United States Patent and Trademark Office directed to the subject matter of this application disclosed the following U.S. Pat. Nos. 1,923,716; and 4,113,101.

None of the prior art patents uncovered in the search disclosed a container having a body wall formed from a unitary ply of paperboard with overlapping end portions secured together and with the inner end portion being notched to provide a ledge surface for closing the opening between the lid and the container body in the area of the lap joint.

SUMMARY OF THE INVENTION

It is an object of this invention to provide a generally sift-proof or liquid-resistant container.

A more specific object of the invention is the provision of a single lap tubular container having a plug-type closure and means for preventing material from leaking out of the container through the space between the closure and container in the area of the lap joint.

These and other objects of the invention will be apparent from an examination of the following description and drawings.

It will be understood, that for purposes of clarity, certain elements may have been intentionally omitted from certain views where they are believed to be illustrated to better advantage in other views.

DESCRIPTION OF THE PREFERRED EMBODIMENT

Figure 1:
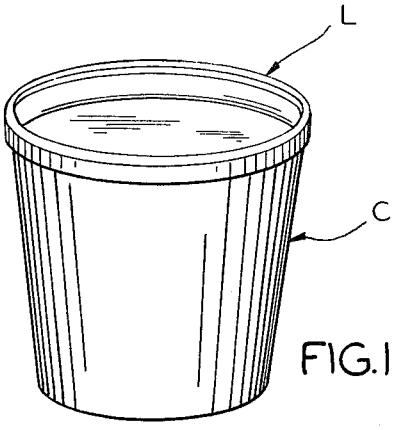
FIG. 1 is a perspective view of a container and lid embodying features of the invention.

Referring now to the drawings for a better understanding of the invention, it will be seen that the package illustrated in FIG. 1 includes a generally cylindrical container, indicated generally at C, the upper end of which may be closed by a plug-type closure or lid, indicated generally at L.

Figure 2:
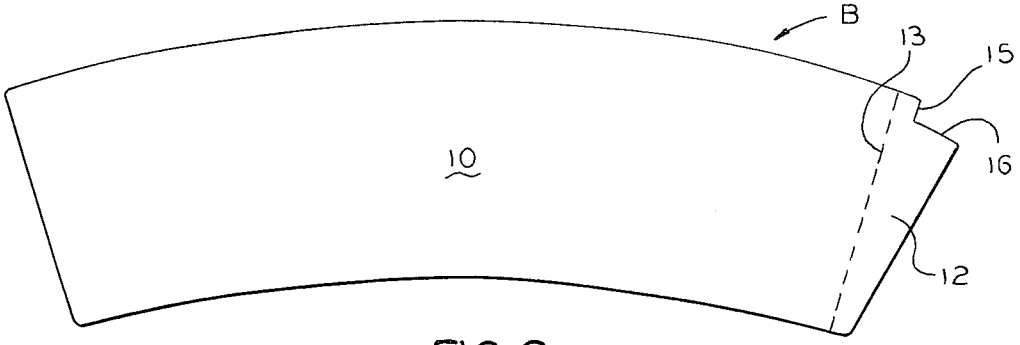
FIG. 2 is a plan view of a blank of foldable paperboard from which the body wall of the container illustrated in the other views may be formed.
Figure 3:
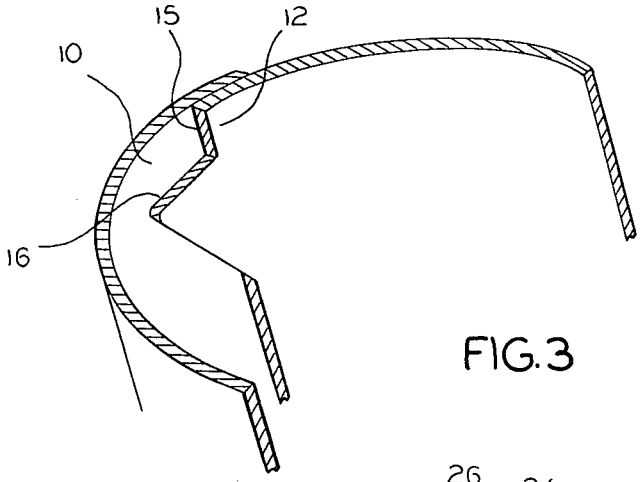
FIG. 3 is a fragmentary, perspective view of an upper portion of the container body wall embodying features of the invention.

The container C includes a body wall which is formed from a unitary blank of foldable sheet material such as paperboard, illustrated in FIG. 2. As best seen in FIG. 2 the body wall includes a main panel 10, which is substantially equal in width to the circumference of the container body, and an extension 12, which provides material for an overlap. The line 13, which is merely for illustrative purposes, indicates where portion 12 extends beyond main panel 10, as best seen in FIG. 3.

Extension 12 has a recess 15 in the upper corner thereof and presents an upwardly facing ledge or abutment surface 16 adjacent the recess, the purpose of which is described hereinafter.

Figure 4:
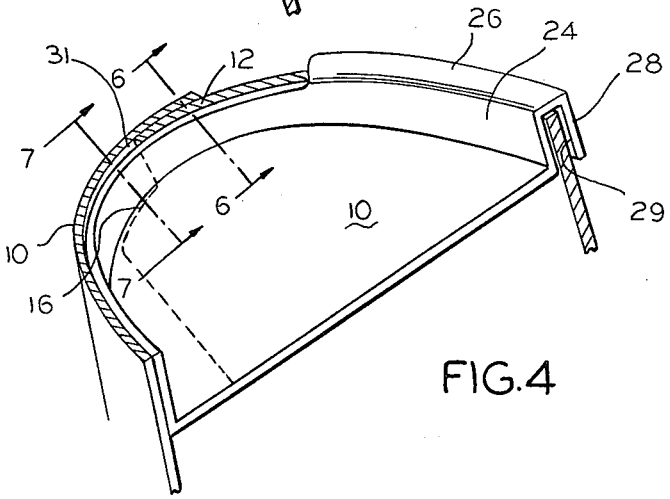
FIG. 4 is a view similar to FIG. 3 but illustrating portions of a closure lid positioned on the container body.
Figure 7:
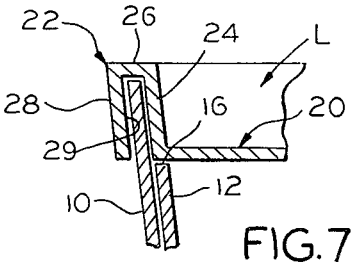
FIGS. 6 and 7 are fragmentary, transverse, vertical sectional views taken on lines 6—6 and 7—7, respectively, of the structure illustrated in FIG. 4.
Figure 6:
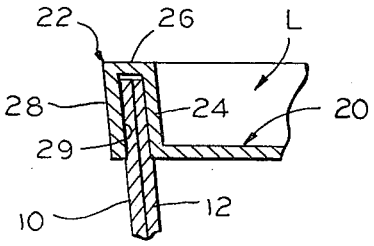

Turning now to FIGS. 4, 6 and 7, it will be seen that the lid L is a plug-type closure having a depressed or lowered central section or panel 20 with an integral, peripheral rim 22. Rim 22 includes a pair of concentric, radially spaced inner and outer flanges 24 and 28, respectively, the upper ends of which are attached to each other by an integrally formed, relatively narrow, annular top flange 26 which forms with the inner and outer flanges an annular channel 29 for receipt of the upper end of the container body, as best seen in FIG. 4.

Figure 5:
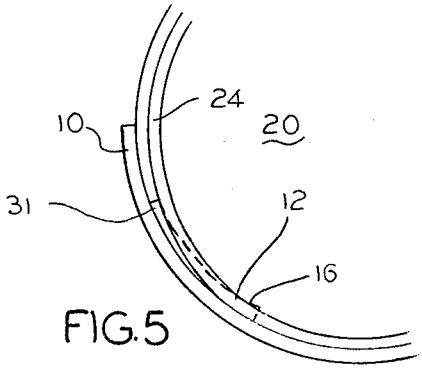
FIG. 5 is a fragmentary, top plan view of the structure illustrated in FIG. 4.

Still referring to FIG. 4, and also to FIG. 5, it will be seen that there is a space or axially extending channel 31 which occurs naturally between the outer surface of lid inner flange 24 and the inner surface of the outer or main ply 10 of the container body wall in the area immediately adjacent the area of overlap. This space occurs because the container body wall is thicker in the area of the lap joint, and this creates separate points of tangency between the lid and container. In the space between the two points of tangency is an opening 31 through which liquid, powder or other materials in the container could sift out of the container.

By the novel construction of applicant's invention, there is provided a means to close this opening and prevent such leaking of packaged material. This is accomplished by providing the notch 15 in the extension 12 of the body wall panel 10. Adjacent the recess 15, there is presented the upwardly facing abutment surface or ledge 16.

It is to be understood that the height of the recess 15 is approximately equal to the height of the lid inner flange 24, so that part of the container lid will fit in the area of the recess above the ledge or abutment surface 16. As best seen in FIG. 5, the inner lap portion 12 which has the recess 15 is immediately below the opening 31, so that the upwardly facing surface 16 on the extension 12 of the body wall panel is directly under and serves to close the opening 31.

Thus, the invention provides a very simple and inexpensive means of plugging an opening that naturally occurs in a single lap container with a plug-type closure.

What is claimed is:

1. A leak-resistant closure arrangement for a single lap container and lid, comprising:

(a) a container body having a wall formed from a single ply of flexible sheet material, such as paperboard, which is formed into a tubular structure with outer and inner end portions secured to each other in overlapping relation;

(b) said inner end portion having an extension with a recess at the upper corner thereof and presenting, adjacent said recess, an upwardly facing shoulder surface, said outer end portion overlapping said recess and said extension throughout its entire length;

(c) a plug-type lid having a round center section and an integral, annular rim section including:

(i) a generally cylindrical inner flange extending upwardly from the outer periphery of said center section;

(ii) a generally cylindrical outer flange concentric with but spaced radially outward from said inner flange;

(iii) a relatively narrow upper flange interconnecting upper edges of said inner and outer flanges and defining therewith an annular channel for receiving an upper end portion of said container body wall;

(d) the height of said lid inner flange being substantially equal to the depth of said body wall recess, so that when said lid center section is inserted into the upper end of said container and an upper end portion of said container body wall is received within said lid rim channel, said container body wall ledge surface will be positioned immediately below said lid center section and inner flange in the area adjacent said overlap to block the opening between the lines of tangency where the lid inner flange contacts the inner and outer body wall end portions.

* * * * *